United States Patent [19]

Johansson

[11] Patent Number: 5,012,967

[45] Date of Patent: May 7, 1991

[54] ELECTRIC TOOL FOR DRIVING IN FIXING ELEMENTS

[75] Inventor: Mats Johansson, Hestra, Sweden

[73] Assignee: Isaberg AB, Hestra, Sweden

[21] Appl. No.: 424,271

[22] PCT Filed: May 11, 1988

[86] PCT No.: PCT/SE88/00242

§ 371 Date: Oct. 25, 1989

§ 102(e) Date: Oct. 25, 1989

[87] PCT Pub. No.: WO88/08779

PCT Pub. Date: Nov. 17, 1988

[30] Foreign Application Priority Data

May 15, 1987 [SE] Sweden ..... 8701998

[51] Int. Cl.[5] ..... B25C 7/17

[52] U.S. Cl. ..... 227/7; 227/78; 307/41; 361/167; 361/190

[58] Field of Search ..... 227/7, 78, 227; 307/38, 307/40, 41; 310/19, 30, 34; 318/102, 125–127; 361/166, 167, 189, 190, 191

[56] References Cited

U.S. PATENT DOCUMENTS

| | | | |
|---|---|---|---|
| 3,866,051 | 2/1975 | Shearer et al. | 250/551 |
| 4,579,029 | 4/1986 | Sunaga | 83/364 |
| 4,589,581 | 5/1986 | Balma | 227/7 |
| 4,750,661 | 6/1988 | Pane | 227/7 |

FOREIGN PATENT DOCUMENTS

| | | |
|---|---|---|
| 2829769 | 1/1980 | Fed. Rep. of Germany . |
| 1515920 | 6/1978 | United Kingdom . |

*Primary Examiner*—Timothy V. Eley

*Attorney, Agent, or Firm*—Shapiro and Shapiro

[57] ABSTRACT

An electric tool for driving in fixing elements (10) into an object (4) by means of a magnetic field generated by supplying magnetizing current to an electromagnetic device, comprises a circuit means (17) which is adapted, when activated, to supply magnetizing current to said electromagnetic device. The tool comprises two actuators (18, 19) alternatively connectible to the circuit means (17) and adapted, when actuated, to activate the circuit means, one (18) of the actuators being an actuator which is activatable in a potential-free mode and which is, in an initial position, unconnected to the circuit means, and the other (19) of the actuators being connected to the circuit means in the initial position. An activating means (25) is connectible to an actuator (18') which is activatable in a potential-free mode and included in a subsequent, similar tool, said activating means being adapted to be actuated by the circuit means (17) to produce, with a time delay after the actuation of said circuit means, a potential-free signal for actuation of said actuator (18') which is activatable in a potential-free mode and included in the subsequent tool. The actuator (18) which is activatable in a potential-free mode, is activatable by an activating means connected thereto, such as the activating means (25'') of a preceding similar tool, so as to activate the circuit means (17) after being connected thereto.

3 Claims, 3 Drawing Sheets

ELECTRIC TOOL FOR DRIVING IN FIXING ELEMENTS

BACKGROUND OF THE INVENTION

The present invention relates to an electric tool for driving in fixing elements, such as staples and nails, into an object by means of a magnetic field generated by supplying magnetising current to an electromagnetic device, said tool having a circuit means which is adapted, when activated, to supply magnetising current to said electromagnetic device.

In a prior art staple tacker of this type to be connected to mains voltage, an actuator is used which, when actuated, activates said circuit means to supply a magnetising current pulse to said electromagnetic device. To operate the actuator, an electric signal is supplied to the input thereof. The electric signal is generated when an object, such as a sheaf of papers to be stapled, has been inserted in the staple tacker and comes into engagement with an activating means.

Frequently, several such staple tackers are used together, for example when a number of papers in a sheaf are to be stapled together at various points. If the stapling points are in alignment with each other, the staple tackers are arranged beside one another, their activating means being aligned for simultaneous actuation when the sheaf of papers has been inserted in the staple tackers. The circuit means of the staple tackers are all activated at the same time to supply a magnetising current pulse to each electromagnetic device, which results in a high line load. If the stapling points are not aligned but are distributed in such manner that the staple tackers cannot be arranged for simultaneous actuation of their activating means, effective stapling requires actuation of the activating means of one staple tacker to actuate, in its turn, the activating means of the other staple tackers.

SUMMARY OF THE INVENTION

A special object of the present invention is, therefore, to provide a staple tacker which is readily connectible with other similar staple tackers for delayed actuation of the circuit means of the staple tackers, the connection being such that the staple tackers are independent of which mains voltage phase is connected to the respective staple tacker.

A more general object of the present invention is to provide an electric driving tool which can be connected with other similar tools in the manner stated above.

This general object is achieved by means of an electric tool which is of the type mentioned by way of introduction and which is characterised by two actuators alternatively connectible to the circuit means and adapted, when actuated, to activate said circuit means, one of said actuators being an actuator which is activatable in a potential-free mode and which is, in an initial position, unconnected to said circuit means, and the other of said actuators being connected to said circuit means in the initial position; and an activating means connectible to the actuator which is activatable in a potential-free mode and included in an optionally subsequent, similar tool, said activating means being adapted to be actuated by said circuit means to produce, with a time delay after the actuation of said circuit means, a potential-free signal for actuation of said actuator which is activatable in a potential-free mode and included in the optionally subsequent tool, said actuator which is activatable in a potential-free mode, being activatable by an activating means connected thereto, such as the activating means of the optionally preceding, similar tool so as to activate said circuit means after connection thereto.

In a preferred embodiment, the actuator which is activatable in a potential-free mode, is activatable by application of a light signal, such as an IR light signal, and the activating means is adapted to produce a light signal, such as an IR light signal.

In another preferred embodiment, the actuator which is activatable in a potential-free mode, is adapted, on connection of an activating means thereto, to be connected to said circuit means.

BRIEF DESCRIPTION OF THE DRAWINGS

The invention will now be described in greater detail below with reference to the accompanying drawings in which.

DETAILED DESCRIPTION OF THE INVENTION

Figure 1:
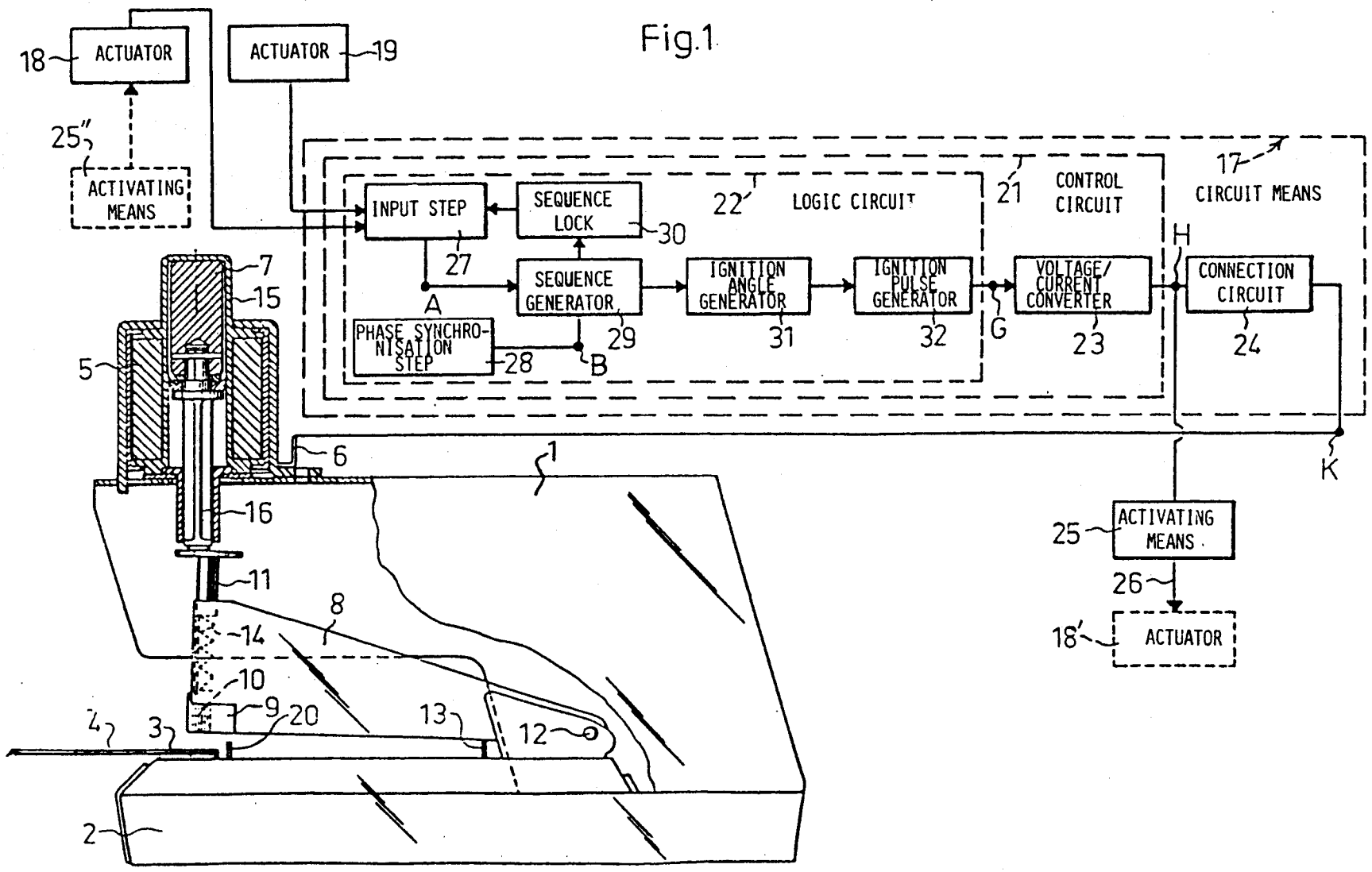
FIG. 1 is a schematic, part-sectional view of a staple tacker according to the present invention, provided with one circuit means, two actuators and one activating means which are shown in the form of a block diagram, the staple tacker being shown in an initial position.

The staple tacker shown in FIG. 1 has a frame 1 comprising a lower support 2 with an anvil 3 on which an object 4, such as a sheaf of papers to be stapled, is laid. The frame 1 supports an electromagnetic device comprising a coil 5 with terminals 6 and an armature 7. The frame 1 further supports a driving device 8 in which a magazine 9 for staples 10 and a driver 10 for striking the staples 11 one by one, are arranged, and which is pivotable about a horizontal spindle 12 relative to the support 2. The driving device 8 is pivotable, against the action of a first spring 13, from a loading position (FIG. 1) in which an object 4 can be laid on the anvil 3, to a driving position in which the magazine 9 abuts the object 4. In the initial position of the staple tacker (FIG. 1), the spring 13 retains the driving device 8 in the loading position.

The driver 11 is movable, against the action of a second spring 14, relative to the magazine 9 which is fixedly connected with the driving device 8, from an initial position (FIG. 1) to a striking position for striking a staple 10 out of the magazine 9 and driving it into the object 4 lying on the anvil 3. In the initial position (FIG. 1) and the abutment position of the staple tacker, in which the driving device 8 is in the driving position, the second spring 14 retains the driver 11 in the initial position. The second spring 14 yields a greater return force than the first spring 13.

The coil 5 of the electromagnetic device is wound around a tubular core 15. The armature 7 is reciprocably mounted in the tubular core 15 and cooperates in conventional manner with the driver 11 via a push rod 16. In FIG. 1, the armature 7 is shown in its upper or initial position to which it has been returned and in which it is retained by the first spring 13 which has returned the driving device 8 to the loading position, and by the second spring 14 which has returned the driver 11 to the initial position. From its initial position, the armature 7 is adapted to perform a downward driving stroke under the action of a magnetic field generated by supplying magnetising current to the electromagnetic device.

During its driving stroke, the armature 7 moves, via the push rod 16, the driver 11 and the second spring 14, first the driving device 8 from the loading position (FIG. 1) to the driving position and then, via the push rod 16, the driver 11 from its initial position to its striking position.

The magnetising current required for generating the magnetic field for performing the driving stroke of the armature 7, is supplied by a circuit means 17 to the terminals 6 of the electromagnetic device. The circuit means 17 is mounted in the staple tacker but is in FIG. 1, for the sake of simplicity, shown as a block diagram outside the staple tacker.

The circuit means 17 is connected to A.C. voltage V (FIG. 3), in this case the mains voltage, and is adapted, when activated, to produce a magnetising current pulse and supply it to the electromagnetic device. The circuit means 17 is activated by one of two actuators 18 and 19 which are alternatively connectible thereto. When the actuator 18 or 19 connected to said circuit means 17 is actuated, it activates the circuit means by supplying a logic signal thereto. The actuator 18 which is activatable in a potential-free mode, is in the embodiment shown activatable in that an IR light signal IR (FIG. 2) is applied to the input thereof, and is, in the initial position, not connected to the circuit means 17. The other actuator 19 is, in the embodiment shown, activatable in that an electric circuit connected thereto is interrupted (at S1 in FIG. 2). This interruption is effected in known manner in that an object 4, when laid on the anvil 3, is engaged with an activating means 20, but can of course be effected in a different manner, e.g. in that the user operates a pedal or the like. The actuator 19 is connected to the circuit means 17 in the initial position.

The actuator 18 which is activatable in a potential-free mode, is adapted, on connection of an activating means thereto, to be connected to the circuit means 17 and thereby to disconnect the other actuator 19 therefrom.

The circuit means 17 comprises a control circuit 21 which consists of a logic circuit 22 and a poweramplifying voltage/current converter 23, and a connection circuit 24. When receiving the above-mentioned logic signal, the logic circuit 22 produces in a predetermined half cycle H1 (FIG. 3) of the mains voltage, i.e. with a predetermined time delay, a voltage spike V1 (FIG. 3) the time of which is accurately determined relative to the zero point 01 of the mains voltage which initiates the half cycle in which the voltage spike is produced. The voltage spike V1 is supplied to the power-amplifying voltage/current converter 23 which converts it into an amplified current spike A1 (FIG. 3) to be supplied to the connection circuit 24. The connection circuit 24 which consists of a triac, receives the current spike A1 and supplies a current pulse A'1 (FIG. 3) to the electromagnetic device by supplying thereto the mains voltage V during the part (the hatched portion at J in FIG. 3) of said half cycle H1 of the mains voltage, which remains after the current spike A1 has been produced.

By determining the time of the voltage spike V1 relative to the zero point 01 of the mains voltage, it is possible to control the power content of the current pulse A'1. The time of the voltage spike V1 is determined in such manner that the current pulse A'1 obtains a power content which is adapted to produce a magnetic field which supplies the armature 7 with kinetic energy sufficient to move the driving device 8 from the loading position to the driving position and to move the driver 11 from the initial position to the firing position and thus to strike a staple 10 out of the magazine 9 and drive it into the object 4 lying on the anvil 3.

The staple tacker is further provided with an activating means 25 which is connected to the converter 23 to receive the current spike A1 produced by the converter and thus produce an IR light signal. The activating means 25 is connectible by means of a light guide 26 to an actuator 18' which is activatable in a potential-free mode and included in a subsequent similar staple tacker, so as to connect said actuator to the circuit means of the subsequent staple tacker. Correspondingly, the activating means 25'' of a preceding similar staple tacker can be connected to the actuator 18 which is activatable in a potential-free mode, so as to connect it to the circuit means 17. In this manner, a plurality of similar staple tackers can be connected in series in a potential-free mode so as to activate their circuit means with a time delay relative to each other. Thus, the circuit means of the first staple tacker or master unit is activated by the actuator connected thereto in the initial position, while the circuit means of the remaining staple tackers or slave units are activated by the actutator which is activatable in a potential-free mode.

The circuit means 17, the actuators 18 and 19 and the activating means 25 will now be described in greater detail.

The logic circuit 22 comprises an input step 27, a phase synchronisation step 28, a sequence generator 29, a sequence lock 30, an ignition angle generator 31 and an ignition pulse generator 32.

The input step 27 receives the above-mentioned logic signal which is here a logic 0, either from the actuator 19 (initial position) or from the actuator 18. The input step 27 filters interference in the logic signal and supplies to the sequence generator 29 a filtered logic signal L which appears at point A in FIGS. 1 and 2 (curve A in FIG. 3).

Figure 2:
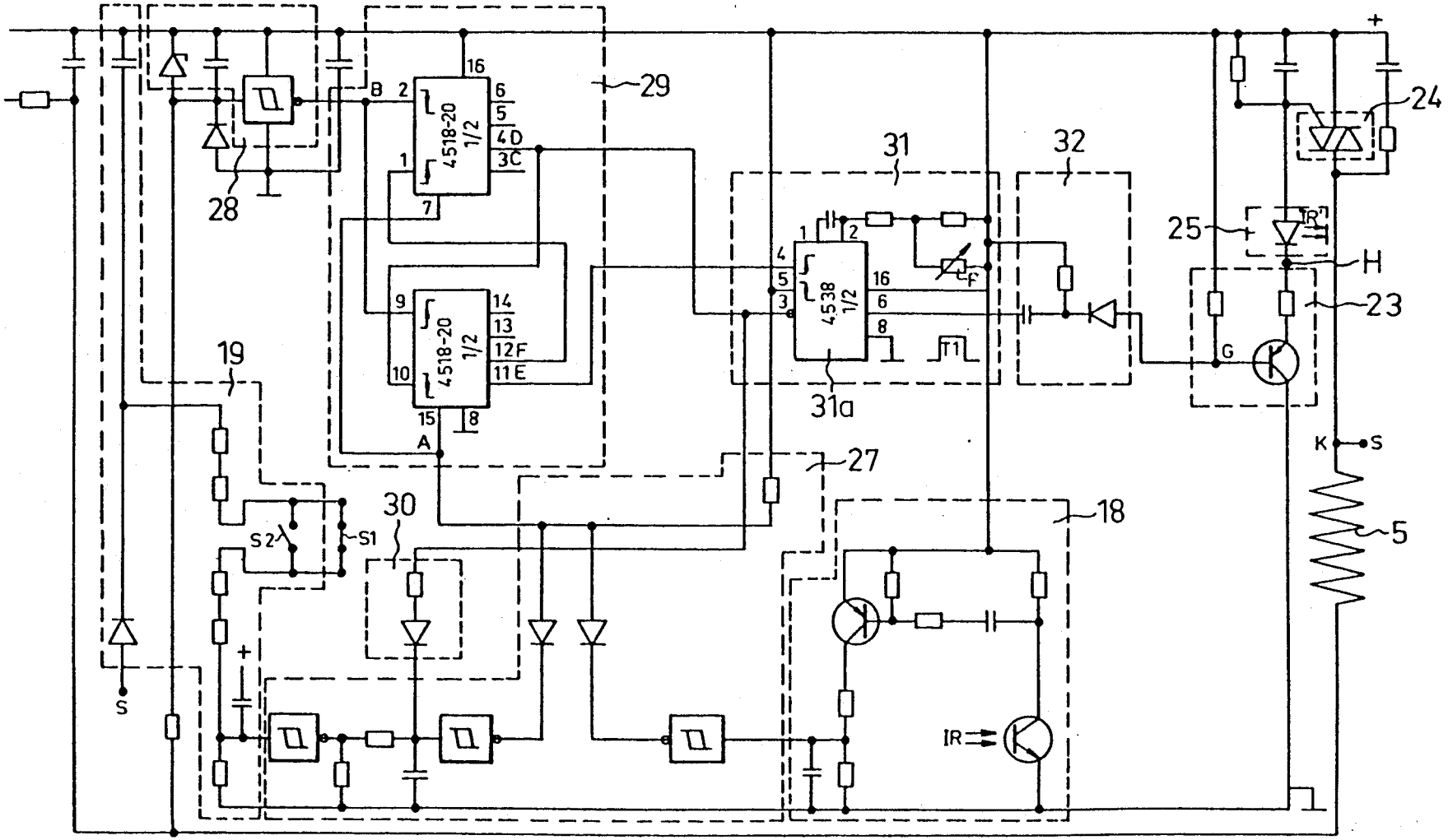
FIG. 2 illustrates a detailed wiring diagram for said circuit means.
Figure 3:
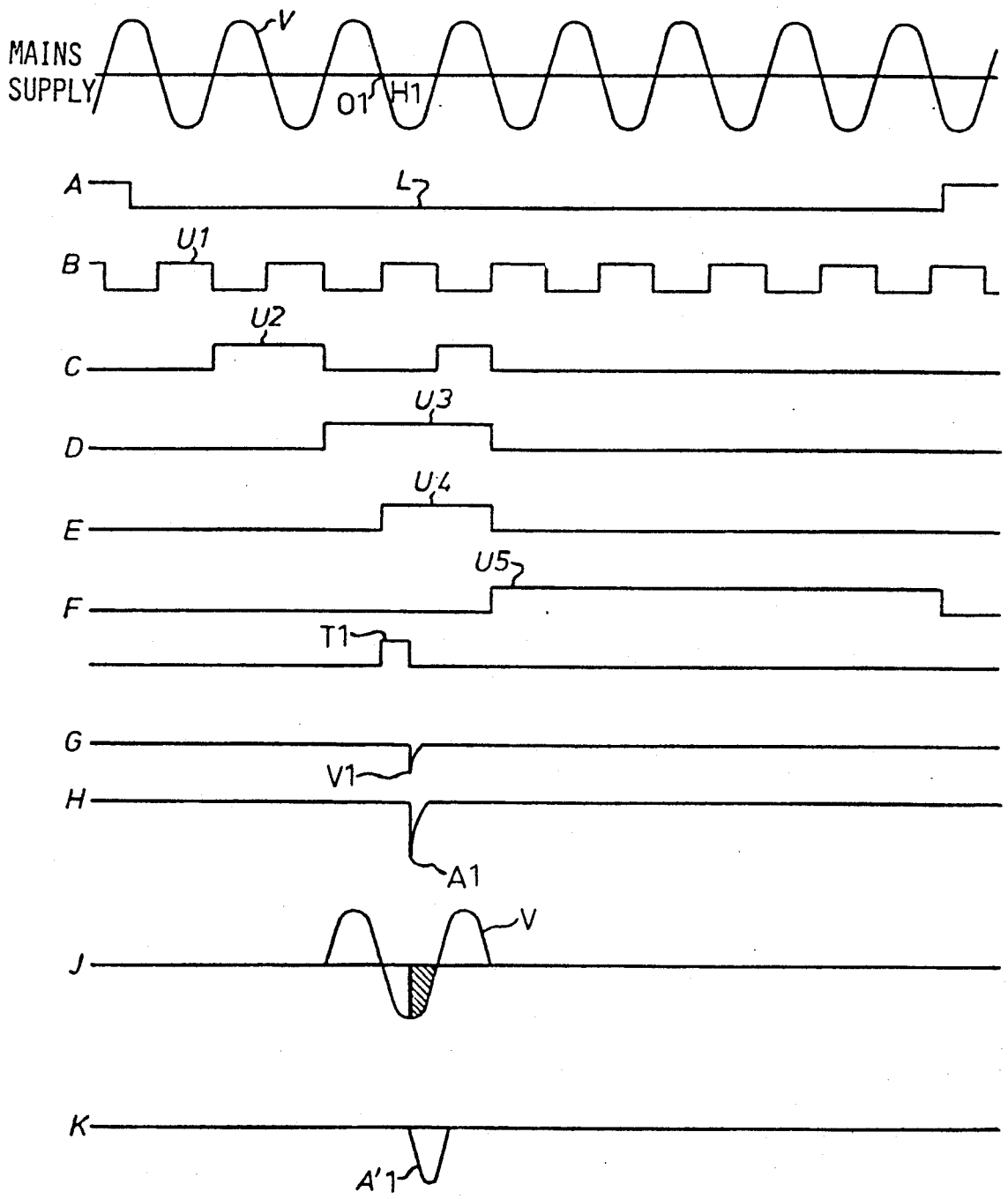
FIG. 3 shows current and voltage pulses at different points in the wiring diagram in FIG. 2.

The phase synchronisation step 28 is connected to the mains voltage V (FIG. 3) so as to supply to the sequence generator 29 a square wave voltage U1 which is phase-synchronised with regard to the mains voltage and phase-shifted through, in this case, 180° and which appears at point B in FIGS. 1 and 2 (curve B in FIG. 3).

When receiving the filtered logic signal L and the square wave voltage U1 at the terminals 3, 4, 11 and 12, each corresponding to a point C, D, E and F, respectively, in FIG. 2, the sequence generator 29 which consists of an IC circuit, such as CMOS 4518 or 4520, provides a voltage signal U2, U3, U4 and U5, respectively, (curve C, D, E and F, respectively, in FIG. 3). When the signal U5 at point F becomes high, a predetermined sequence is ready; the sequence generator 29 stops and the signals U2, U3 and U4 at points C, D and E become low and are kept in this state. As a result, the armature 7 of the staple tacker performs only one striking stroke, even if the input step 27 should receive the logic signal L (=0) for a longer period of time.

The sequence lock 30 receives the signal U3 and, by being connected to the input step 27, locks the filtered logic signal L at 0 during the active part of the sequence, i.e. the part of the sequence extending from the moment when the mains voltage V has its first positive zero point, after the filtered logic signal L has become 0, up to the moment when the signal U5 at point F becomes high. Such locking is provided independently of whether the input step 27 is still receiving the logic signal (=0) or not.

The ignition angle generator 31 comprises a time block 31*a* included in an IC circuit, such as CMOS 4538. The time block 31*a* receives the voltage signals U3 and U4, as shown in FIG. 2. When the signal U3 becomes high, the time block 31*a* produces at its terminal 6 a positive voltage pulse T1 (FIG. 3). The pulse length of the voltage pulse T1 depends on the RC value in the ignition angle generator circuit. As shown in FIG. 2, this circuit comprises a potentiometer P by means of which the pulse length of the pulse T1 can be set.

The ignition pulse generator 32 receives the voltage pulse T1 and produces a negative voltage spike forming the above-mentioned voltage spike V1 which appears at point G in FIGS. 1 and 2 (curve G in FIG. 3). The voltage spike V1 is produced on the negative edge of the voltage pulse T1.

The power-amplifying voltage/current converter 23 receives the voltage spike V1 and converts it into an amplified negative current spike forming the above-mentioned current spike A1 which appears at point H in FIGS. 1 and 2 (curve H in FIG. 3).

The connection circuit 24 which, as mentioned above, consists of a triac (two tyristors connected in anti-parallel), receives the current spike A1 and supplies a current pulse to the coil 5 of the electromagnetic device via the terminal 6 by connecting the mains voltage V during the part (the hatched portion at J in FIG. 3) of the half cycle H1 of the mains voltage V that remains after the current spike A1 has been produced. This current pulse constitutes the above-mentioned current pulse A'1 which appears at point K in FIGS. 1 and 2 (curve K in FIG. 3).

The activating means 25 also receives the current spike A1 so as to produce an IR light signal IR' (FIG. 2) for optional application to the actuator 18' which is activatable in a potential-free mode and included in a subsequent similar staple tacker (FIG. 1).

As mentioned above, the actuator 18, which is activatable in a potential-free mode, is arranged such that, when connecting thereto an activating means, such as the activating means 25'' of an optionally preceding, similar staple tacker, it is connected to the circuit means 17 and thereby disconnects the second actuator 19 therefrom. Such disconnection is effected in that the connection of the actuator 18 which is activatable in a potential-free mode, provides such a closing of the above-mentioned circuit connected to the actuator 19, that said circuit cannot be interrupted, e.g. in that an object 4 is brought into engagement with the activating means 20. This function is illustrated in FIG. 2 by a switch S2 which is normally open, but which is closed and thus prevents interruption of the circuit by means of the switch S1, as soon as an activating means, e.g. the activating means 25'', is connected to the actuator 18 which is activatable in a potential-free mode.

What is claimed is:

1. An electric tool for driving in fixing elements (10), such as staples and nails, into an object (4) by means of a magnetic field generated by supplying magnetising current to an electromagnetic device, said tool having a circuit means (17) which is adapted, when activated, to supply magnetising current to said electromagnetic device, characterised by two actuators (18,19) alternatively connectible to said circuit means (17) and adapted, when actuated, to activate said circuit means, one (18) of said actuators being an actuator which is activatable in a potential-free mode and which is, in an initial position of the tool, unconnected to said circuit means, and the other (19) of said actuators being connected to said circuit means in the initial position, and an activating means (25) adapted to be actuated by said circuit means (17) to produce, with a time delay after the actuation of said circuit means, a potential-free signal for actuation of an actuator (18') which is activatable in a potential-free mode and included in an optionally subsequent said tool, said one actuator (18) being activatable by a said activating means of an optionally preceding said tool, so as to activate said circuit means (17) after being connected thereto.

2. A tool as claimed in claim 1, characterised in that said one actuator (18) is activatable by application of a light signal, such as an IR light signal, and that said activating means (25) is adapted to produce a light signal, such as an IR light signal.

3. A tool as claimed in claim 1, characterised in that said one actuator (18) is adapted to be connected to said circuit means (17) upon activation by the said activating means of the preceding tool.

* * * * *